US007770821B2

(12) United States Patent
Pinch

(10) Patent No.: US 7,770,821 B2
(45) Date of Patent: Aug. 10, 2010

(54) IRRIGATION SPRINKLER

(75) Inventor: Daniel R. Pinch, Clermont, FL (US)

(73) Assignee: Senninger Irrigation Inc., Clermont, FL (US)

( * ) Notice: Subject to any disclaimer, the term of this patent is extended or adjusted under 35 U.S.C. 154(b) by 1285 days.

(21) Appl. No.: 11/110,501

(22) Filed: Apr. 21, 2005

(65) Prior Publication Data

US 2006/0249594 A1 Nov. 9, 2006

(51) Int. Cl.

| | |
|---|---|
| ***B05B 3/04*** | (2006.01) |
| ***B05B 3/08*** | (2006.01) |
| ***B05B 3/02*** | (2006.01) |
| ***F23D 11/04*** | (2006.01) |

(52) U.S. Cl. ..... 239/222.21; 239/210; 239/222.11; 239/222.17; 239/231

(58) Field of Classification Search ..... 239/210, 239/214.13, 222.11, 222.17, 222.21, 231, 239/232

See application file for complete search history.

(56) References Cited

U.S. PATENT DOCUMENTS

| | | | | |
|---|---|---|---|---|
| 2,848,276 | A * | 8/1958 | Clearman | 239/382 |
| 3,312,400 | A * | 4/1967 | Clearman | 239/206 |
| 4,398,666 | A | 8/1983 | Hunter | |
| 4,796,811 | A | 1/1989 | Davisson | |
| RE33,823 | E | 2/1992 | Nelson et al. | |
| 5,372,307 | A | 12/1994 | Sesser | |
| 5,381,960 | A | 1/1995 | Sullivan et al. | |
| 5,439,174 | A | 8/1995 | Sweet | |
| 5,671,886 | A | 9/1997 | Sesser | |
| 5,950,927 | A | 9/1999 | Elliott et al. | |
| 6,176,440 | B1 * | 1/2001 | Elliott | 239/222.21 |
| 7,395,977 | B2 * | 7/2008 | Pinch et al. | 239/222.21 |

* cited by examiner

*Primary Examiner*—Len Tran
*Assistant Examiner*—Ryan Reis
(74) *Attorney, Agent, or Firm*—William M. Hobby, III

(57) ABSTRACT

An irrigation sprinkler provides a more even distribution pattern of water over a given area being irrigated by providing a controlled rotation in a wobbling water deflector. A sprinkler base has a nozzle attached thereto and a water deflector rotatably attached to the base. The water deflector and the nozzle each have a plurality of gear teeth thereon which gear teeth are different in number between the water deflector and the nozzle so that they only partially mesh when the water deflector is rotated on the base. The gear teeth also assure that the deflector cannot spin freely causing high rpm.

10 Claims, 3 Drawing Sheets

IRRIGATION SPRINKLER

BACKGROUND OF THE INVENTION

The present invention relates to irrigation sprinklers and especially to sprinklers of the type having a fixed nozzle directing water from a water supply under pressure against a water deflector which deflects the water into a sprinkling pattern while forcing the deflector head to rotate.

It has been common in the past to provide wobbling sprinkler heads to wobble the sprinkler head for a better distribution of the water being deflected. Typical prior U.S. patents for wobbling sprinkler heads can be seen in Applicant's U.S. pat. No. 5,950,927 to Elliott et al. for a wobbling sprinkler head for use in irrigation systems so that instead of being rotated in a smooth rotation, a water distribution head wobbles in a rotating fashion to provide a more even distribution of water. In Applicant's U.S. patent to Sullivan et al. U.S. pat. No. 5,381,960, a wobbling irrigation sprinkler head includes a magnet to provide for an initial tilt of the sprinkler head. The sprinkler head has a base for attaching to a pipe, such as in a central water supply conduit, which base has a nozzle mounted therein for directing water against a wobbling water deflecting head movably attached to the base. The water deflecting head causes the deflector to rotate and wobble.

In the Hunter U.S. Pat. No. 4,398,666, a stream rotor sprinkler has a rotating head and a crown configured stream deflector positioned about the spray head to deflect water spray from a nozzle in the spray head. The deflector is moved in an eccentrically revolving and rotating motion relative to the sprinkler housing and spray head in response to spray head rotation imparted by a cam on the spray head. In the Sweet U.S. Pat. No. 5,439,174, a nutating sprinkler is provided having a body portion having a nozzle on one end and a cap assembly at an opposite end. A spray plate is used to deflect and distribute water and the distribution distributing grooves are formed to rotate the spray plate which is supported on a universal joint in a manner to cause the spray plate to wobble in one direction of rotation when struck by the stream emitted from the nozzle. This sprinkler is provided with conical gear teeth having stator gear teeth meshing with rotor gear teeth. The Sesser U.S. Pat. No. 5,671,886 is a rotary sprinkler stream interrupter. The stream interrupter is mounted loosely for eccentric rotation about the center axis and has a plurality of stream deflector fingers. This patent also provides a viscous brake or rotor motor of the type disclosed in U.S. Pat. No. RE 33,823 and U.S. Pat. No. 4,796,811 and is used to slow the rotation of the rotor plate. A similar U.S. Patent to Sesser U.S. Pat. No. 5,372,307 shows a similar rotary sprinkler stream interrupter.

The present rotating sprinkler head is of the wobbling type which includes a sprinkler base attachable to a water supply and having a fixed nozzle for directing water therefrom against a water deflector which is rotated by the water hitting the deflector surface of the deflector. Annular gears are used between the sprinkler base and the water deflector which gears have different numbered teeth to ensure that the gears never fully mesh which causes the water deflector to tilt relative to the sprinkler base and also controls the rotation of the sprinkler water deflector to prevent uncontrolled rotation and facilitate initiating the wobbling motion.

The wobbling rotation is controlled by the set of partially meshing gears including a fixed set of gear teeth on the base and a rotating pair of gear teeth on the rotating water deflector.

SUMMARY OF THE INVENTION

An irrigation sprinkler provides a more evenly distribution pattern of water over a given area being irrigated by providing a controlled rotation in a wobbling water deflector. A sprinkler base is connected to a water supply and has a nozzle attached thereto. The sprinkler base has a water deflector rotatably attached thereto which has a support collar and a water deflector pad and a plurality of arms supporting the water deflector pad in a spaced relationship to the collar. The water deflector is rotatably attached to the sprinkler base and has a plurality of gear teeth on the collar which are different in number from the plurality of gear teeth around the nozzle. The water deflector is positioned for the collared gear teeth to partially engage the base gear teeth but prevent full engagement in the meshing of the gears because of the different number gear teeth. The water deflector has a deflector pad having a water deflecting surface shaped to deflect water from the nozzle impinging thereupon and to force partial engagement of the gear teeth thereby tilting and rotating the deflector on the sprinkler base. A different number of gear teeth forces the water deflector to tilt by preventing the gears from fully meshing while the deflector pad forces the rotation of the water deflector and controls the speed of rotation of the water deflector.

BRIEF DESCRIPTION OF THE DRAWINGS

Other objects, features and advantages of the present invention will be apparent from the written description and the drawings in which.

DESCRIPTION OF THE PREFERRED EMBODIMENT

Figure 1:
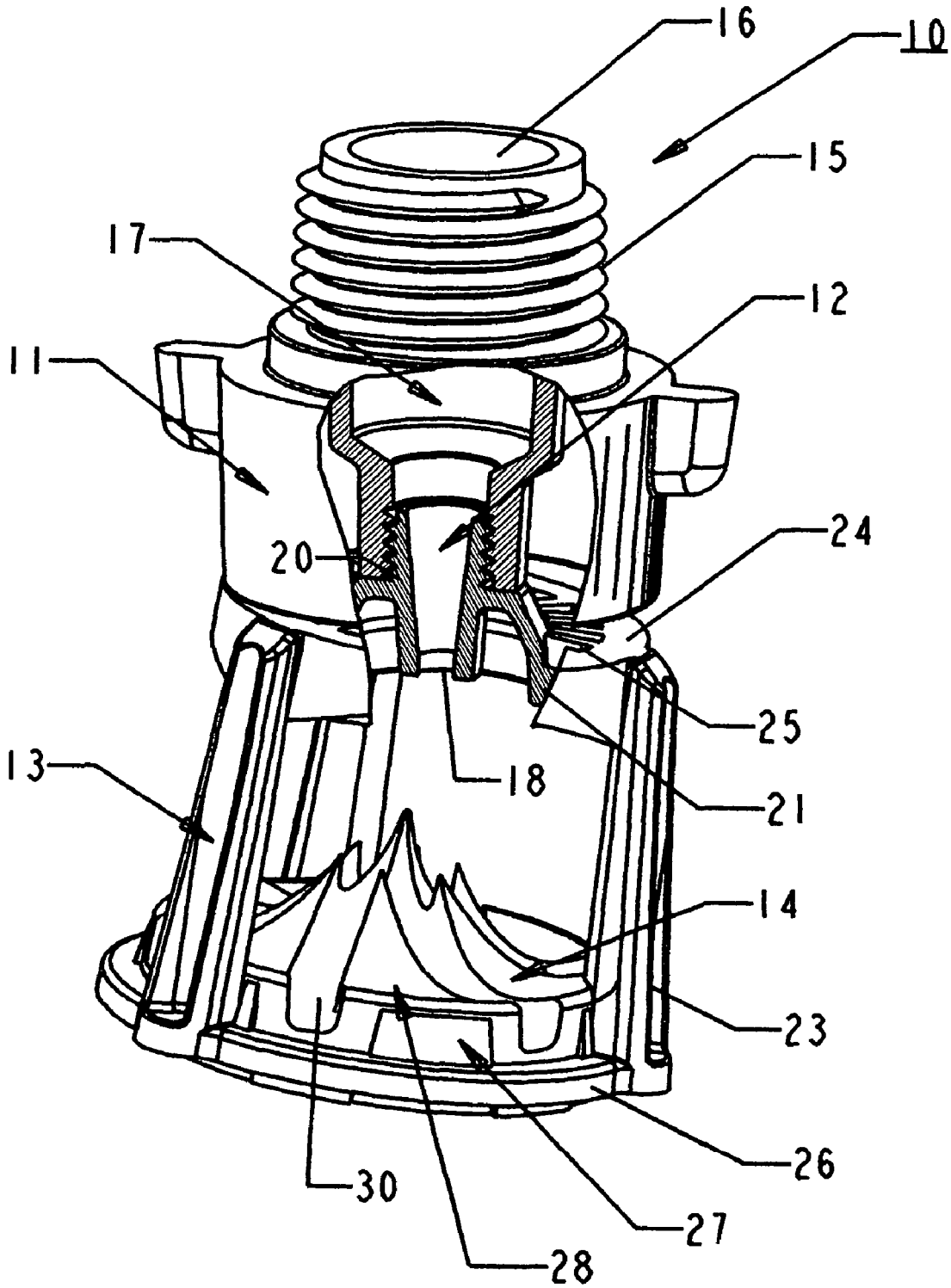
FIG. 1 is a cutaway perspective of a sprinkler in accordance with the present invention.
Figure 2:
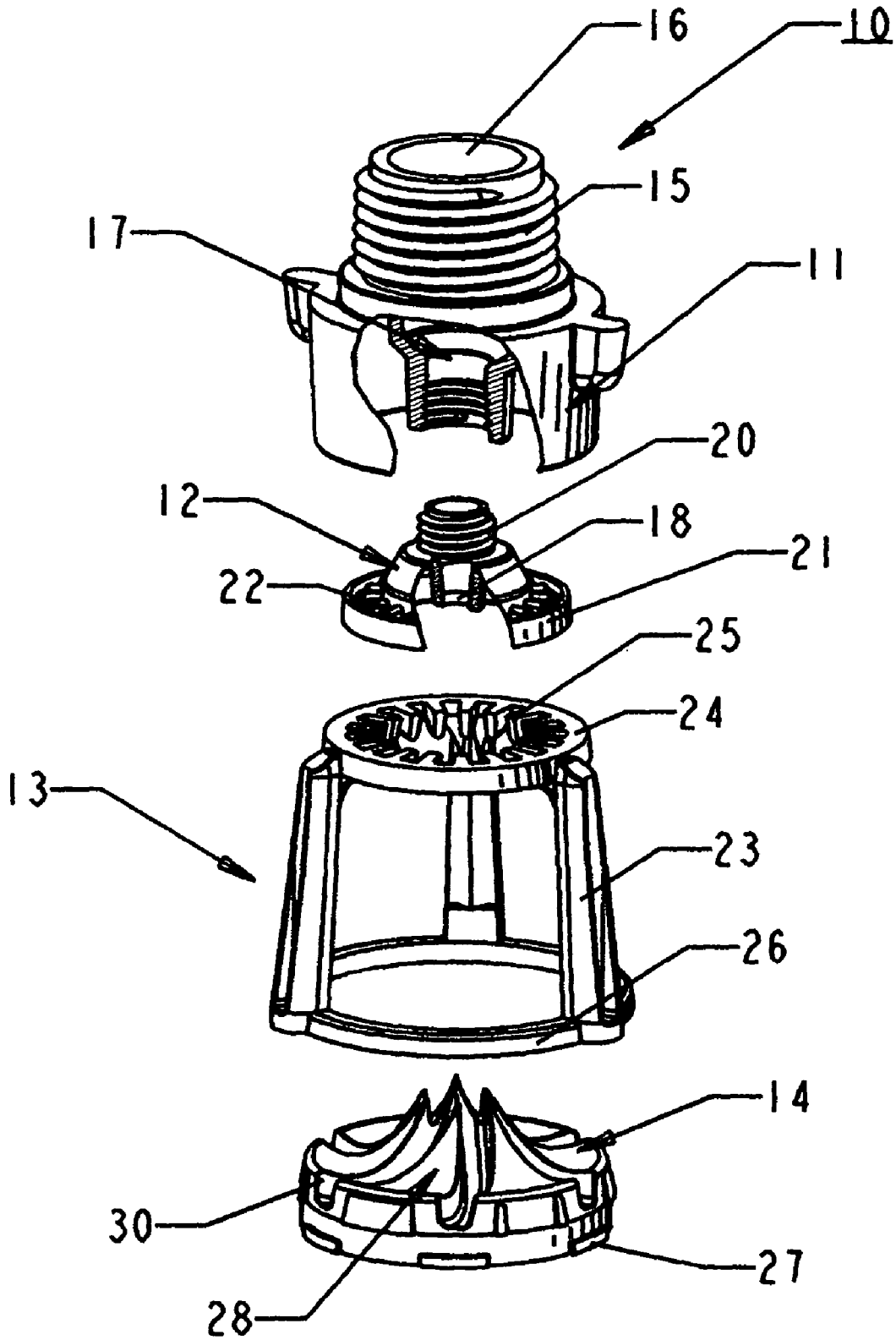
FIG. 2 is an exploded cutaway perspective of the sprinkler of FIG. 1.
Figure 3:
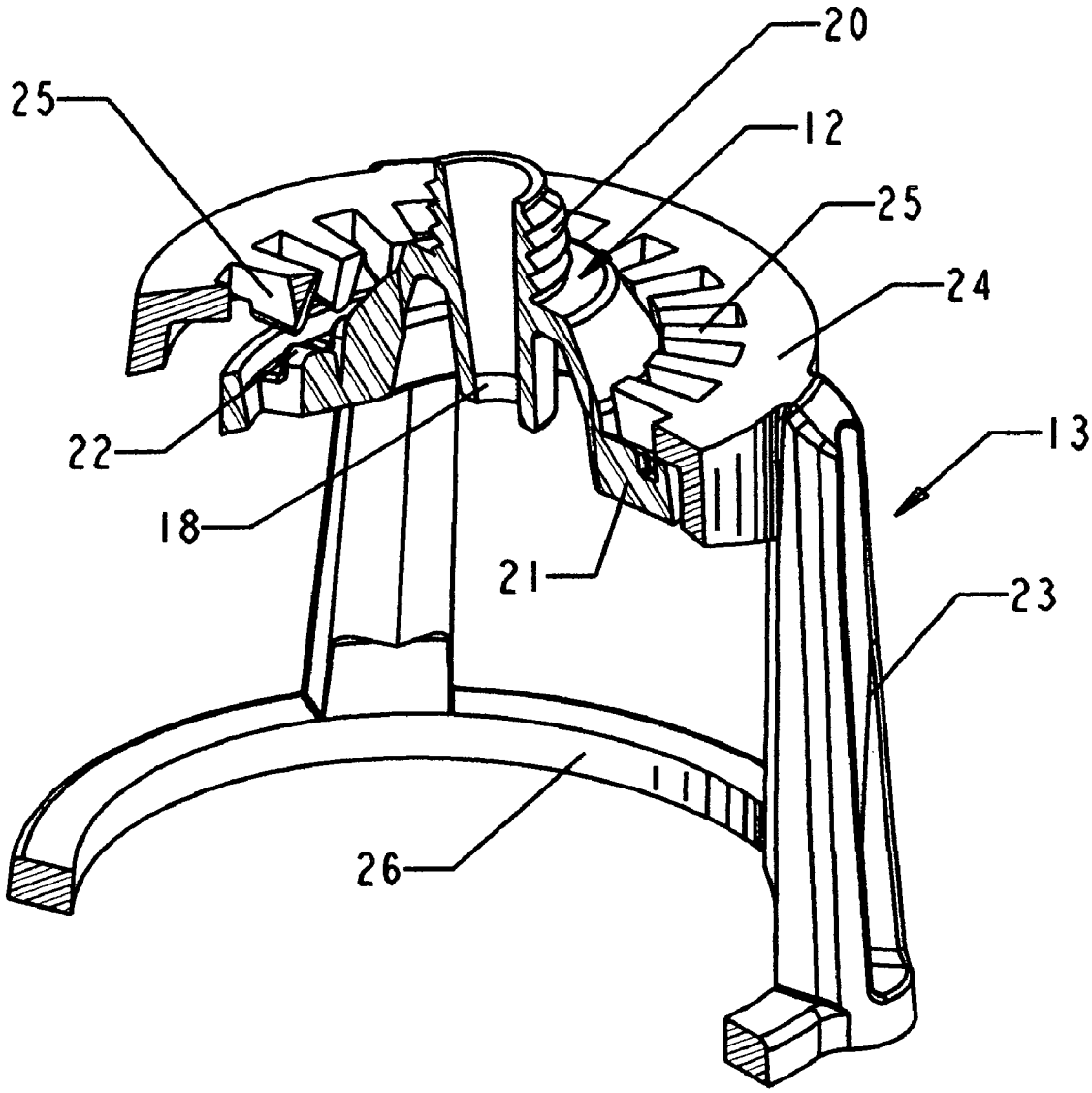
FIG. 3 is a cutaway perspective of the partially meshing gear teeth.

Referring to FIGS. 1-3 of the drawings, a sprinkler 10 is illustrated having a base 11, a nozzle 12 and a water deflector bracket 13 having a water deflector pad 14. The base 11 has external threads 15 for connecting the sprinkler to a water supply for water to enter the inlet 16 and pass through the passageway 17 and into the nozzle 12 where it is directed out of the nozzle outlet 18 directly onto the deflector pad 14.

The nozzle 12 is removably attached to the base 11 with threads 20 but can also form a portion of the base. The nozzle 12 has a flange 21 extending therearound which flange has gear teeth 22 formed therein. It will of course be clear that the flange 21 and gear teeth 22 can also be formed directly onto the base 11 as desired.

The bracket 13 has a plurality of arms 23 which, in this case, is illustrated with three arms but could be one arm or any number of arms as desired. The arms 23 connect between a collar portion 24 of the deflector or deflector bracket 13 which collar 24 has a plurality of gear teeth 25 formed thereon. The deflector bracket 13 also has a base ring 26 having the deflector pad 14 removably attached thereto with bayonet type connectors 27. The connection can be of course of any type desired and can be formed as an integral part of the deflector bracket 13.

Deflector 14 has a deflector surface 28 having a plurality of deflector grooves 30 formed therein and shaped to deflect the water exiting from the nozzle 12 outlet 18. The grooves 30 are shaped to force a rotation of the deflector pad 14 along with the connected water deflector bracket 13. The deflector bracket 13 is loosely connected to the base 11 by passing the nozzle 12, collar 21 under the deflector bracket 13 collar 24 before threading the nozzle 12 into the base 11 with the threads 20.

In operation, the water enters the base 11 through the inlet 16 and a stream of water leaves the nozzle 12 from the outlet 18 and impinges upon the deflector 14 deflector surface 28. The water stream offsets the deflector pad 14 and angles it from a horizontal to an angled position usually between 10 and 25 degrees. The deflector grooves 30 are offset from the center and curved radially so that the velocity of the water exerts a torsional force from the deflector as the water stream impacts the deflector surface. The nozzle 12 flange area 21 has a different number of gear teeth 22 from the deflector bracket collar 24 gear teeth 25. For instance, the nozzle flange 21 may have 18 gear teeth while the deflector bracket collar 24 may have 19 gear teeth 21. Since the collar 24 and gear teeth 25 are supported directly on the flange 21 and gear teeth 22, and there are a different number of gear teeth on the collar 24 than on the flange 21, the gears can never fully mesh. Thus, when water impinges upon the deflector pad 14, the deflector or deflector bracket 13 is forced to tilt so that part of the gear teeth 25 will engage with part of the gear teeth 22 but the remainder of the gear teeth will not be allowed to mesh because of the misalignment of the teeth. When the deflector bracket 13 is forced to rotate by the water impinging upon the deflector pad 14 and through the grooves 30, the partial meshing of the gear teeth will rotate, forcing the deflector bracket 13 to remain in a tilted position as it rotates and thus wobbling as it rotates around the base 11. In addition, the partial meshing of the engaged gear teeth controls the rotation. The gear teeth 22, as seen in FIG. 3, have a rounded surface so that the gear teeth 25 can slide thereinto partial meshing the gears and forcing the advancement of the deflector bracket 13 teeth 25 to rotate in a controlled manner and assuring that there are no voids in the sprinkled area due to the arms 23 remaining stationery.

Other products of this type have a problem in beginning their wobbling motion due to spinning or from the stream impinging upon the deflector pad in such a manner that causes the base and deflector pad axes to align. The alignment of the axes and the force of the water keep the unit from wobbling. The misalignment of the gears assures that the axes can never align and wobbling motion will take place. The forced misalignment of the base and deflector pad axes improves the startability, that is, it contributes greatly in initiating the wobbling motion. The different number of gear teeth also advances the grooves 30 to varying positions. In the case where there are 19 teeth, it would be (360/19=) 18.95 degrees. This is important to assure that the streams do not create an undesirable spoked pattern.

It should be clear at this time that an irrigation sprinkler has been provided which will evenly distribute a pattern of water over a given area to irrigate a surface area and that the gearing will facilitate the rotational movement as well as assure that the deflector pad will not slip uncontrollably in its rotational movement due to the torque incurred from the water stream and have uncontrolled rotation and a high RPM which can cause an undesirable vibration and slippage and premature wear. Accordingly, the present invention is not to be construed as limited to the forms shown which are to be considered illustrative rather than restrictive.

I claim:

1. A sprinkler comprising:

a sprinkler base connectable to a water supply;

a nozzle attached to said sprinkler base for directing water entering said base therefrom, said nozzle having a flange therearound having a plurality of gear teeth;

a water deflector bracket loosely attached to said sprinkler base for rotation and tilting thereon and having a plurality of gear teeth thereon different in number from said nozzle flange plurality of gear teeth and being positioned to partially engage said nozzle flange plurality of gear teeth while preventing full engagement thereof, said water deflector bracket having a plurality of arms extending therefrom;

a water deflector pad fixedly supported on said rotatably deflector bracket plurality of arms below said nozzle for rotation with said water deflector bracket, said water deflector pad having a plurality of grooves therein for deflecting water impinging thereupon from said nozzle to force partial engagement of said water deflector bracket gear teeth with said nozzle flange gear teeth to thereby tilt and rotate said deflector bracket on said sprinkler base;

whereby a sprinkler has a more even coverage of an area being sprinkled and ease of startability.

2. The sprinkler in accordance with claim 1 in which said nozzle is removably attached to said base.

3. The sprinkler in accordance with claim 2 in which said nozzle is threadedly attached to said base.

4. The sprinkler in accordance with claim 3 in which said water deflector bracket has a collar thereon having said gear teeth formed therein and rotatably supported on said nozzle flange with said collar gear teeth riding on said nozzle flange gear teeth.

5. The sprinkler in accordance with claim 4 in which said deflector pad is removably attached to said water deflector bracket.

6. A sprinkler comprising:

a sprinkler base connectable to a water supply;

a nozzle attached to said sprinkler base for directing water entering said base therefrom, said nozzle having a flange therearound having a plurality of gear teeth;

a water deflector extending below said nozzle and having a support collar and a water deflector pad and at least one arm supporting said water deflector pad in a spaced relationship to said collar, said water deflector support collar being loosely attached to said sprinkler base to thereby allow said water deflector to rotate and wobble thereon, said water deflector support collar having a plurality of gear teeth thereon different in number from said plurality of gear teeth on said flange extending around said nozzle;

said water deflector being positioned for said support collar gear teeth to partially engage said plurality of gear teeth on said flange extending around said nozzle while preventing full meshing thereof, and said deflector pad having a plurality of water deflecting grooves therein shaped to deflect water impinging thereupon from said nozzle and to force partial engagement of said gear teeth to thereby tilt and rotate said deflector on said sprinkler base;

whereby a sprinkler has a more even coverage of a sprinkled area and ease of startability.

7. The sprinkler in accordance with claim 6 in which said nozzle is removably attached to said base.

8. The sprinkler in accordance with claim 7 in which said nozzle is threadedly attached to said base.

9. The sprinkler in accordance with claim 1 in which said water deflector support collar has the said gear teeth formed therein and rotatably supported on said nozzle flange with said collar gear teeth riding on said nozzle flange gear teeth.

10. The sprinkler in accordance with claim 9 in which said deflector pad is removably attached to said water deflector bracket.

* * * * *